United States Patent [19]

Sugawara et al.

[11] Patent Number: 4,556,172

[45] Date of Patent: Dec. 3, 1985

[54] FLOW DIRECTION CONTROLLER

[75] Inventors: Norio Sugawara; Motoyuki Nawa; Yutaka Takahashi, all of Nara, Japan

[73] Assignee: Matsushita Electric Industrial Co. Ltd., Osaka, Japan

[21] Appl. No.: 576,393

[22] PCT Filed: May 19, 1983

[86] PCT No.: PCT/JP83/00148

§ 371 Date: Jan. 25, 1984

§ 102(e) Date: Jan. 25, 1984

[87] PCT Pub. No.: WO83/04290

PCT Pub. Date: Dec. 8, 1983

[30] Foreign Application Priority Data

May 25, 1982 [JP] Japan ..... 57-89036
Aug. 24, 1982 [JP] Japan ..... 57-147121

[51] Int. Cl.[4] ..... B05B 1/04

[52] U.S. Cl. ..... 239/590.5; 239/DIG. 7; 60/230; 98/40.18

[58] Field of Search ..... 239/502, 505, 513, 590.5, 239/DIG. 7; 98/40 N, 40 R, 40 V, 41 R, 108; 60/230; 137/829

[56] References Cited

U.S. PATENT DOCUMENTS 4,326,452 4/1982 Nawa et al. ..... 239/590.5
4,327,869 5/1982 Nawa et al. ..... 239/590.5

FOREIGN PATENT DOCUMENTS 33958 10/1980 Japan ..... 239/590.5
18109 2/1981 Japan .
78942 6/1981 Japan .

*Primary Examiner*—Jeffrey V. Nase
*Assistant Examiner*—James R. Moon, Jr.
*Attorney, Agent, or Firm*—Spencer & Frank

[57] ABSTRACT

A flow direction controller mounted on the outlet of an air conditioner or the like and adapted to control the blowing direction of the air. The flow direction controller is composed mainly of two flow-attaching walls and a control blade rotatable on a shaft. The control blades has two surfaces each producing a flow biasing effect and a curved surface. With this arrangement, it is possible to deflect the flow of blowing air over a wide angular range and also to realize a split-flow blowing without being accompanied by a substantial reduction in the air flow rate, by making efficient use of the attachment of the flow components to the attaching walls and the curved surface.

6 Claims, 17 Drawing Figures

List of Reference Numbers

1 ..... blow out passage
2 ..... outlet
3 ..... flow-attaching wall
4 ..... biasing projection
5 ..... flow-attaching wall
6 ..... control blade
7 ..... biasing surface
8 ..... biasing surface
9 ..... curved portion
10 ..... joint portion
11 ..... casing of air conditioner
12 ..... Silocco fan
13 ..... heat exchanger
14 ..... heater
15 ..... inclined top panel
16 ..... lower restriction
17 ..... cam
18 ..... transmission rod
19 ..... transmission shaft
20 ..... jointing projection
21 ..... spring
22 ..... temperature sensor
23 ..... control circuit
24 ..... controller
40 ..... guide plate
60 ..... shaft
70 ..... projection
80 ..... projection

FLOW DIRECTION CONTROLLER

BACKGROUND OF THE INVENTION

The present invention relates to a flow direction controller disposed at the blow-out portion of an air conditioner and adapted to deflect the flow of air from the source to any desired direction.

An air conditioner having both air cooling and air heating functions preferably has a flow direction control adapted to direct the air downwardly in the heating mode and horizontally in the cooling mode, respectively, in order to establish a uniform temperature distribution in the room which is being air conditioned.

The user, however, may feel uncomfortable if the heated air downwardly discharged from the air conditioner in the heating mode impinges upon him at an excessively large rate. On the other hand, an experiment proves that a satisfactorily uniform temperature distribution can be attained by directing only a predetermined part of the discharged air downwardly while directing the other part horizontally. Thus, the air conditioner has been required to have a splitting function for the discharged air to direct a predetermined part of the air downwardly while directing the other horizontally, thereby to attain a good air temperature distribution without making the user uncomfortable.

To comply with this demand, U.S. Pat. No. 4,327,869 shows an arrangement in which, as shown in FIG. 1, the deflection of the discharged air over a wide area and the splitting of the air are conducted by varying the rotational position of a single deflector O. This known arrangement, however, involves the problem that the flow of discharged air encounters a considerably large flow resistance particularly when the deflector O is positioned to produce horizontal and downward flow components of the air.

SUMMARY OF THE INVENTION

Accordingly, the present invention provides a flow direction controller constituted mainly by two flow-attaching walls and a control blade having two biasing surfaces and a curved surface, thereby to permit the splitting of the discharged air through an efficient attaching and deflection of the air flow without being accompanied by a substantial reduction of the flow rate of the discharged air.

DESCRIPTION OF THE PREFERRED EMBODIMENTS

Figure 1:
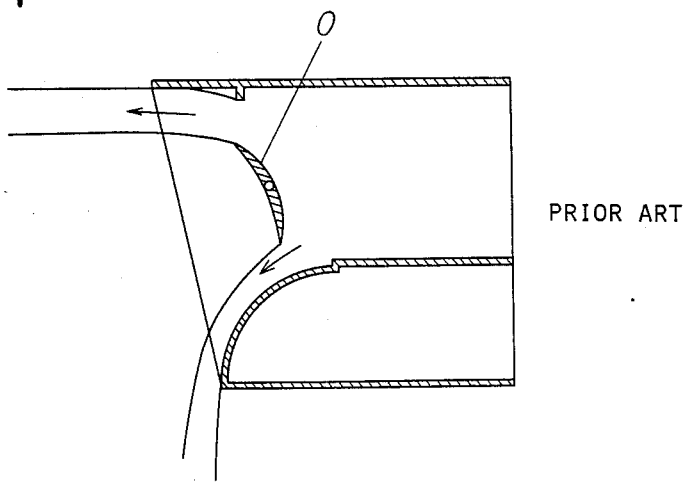
FIG. 1 is a sectional view of an example of a conventional flow direction controller.
Figure 2:
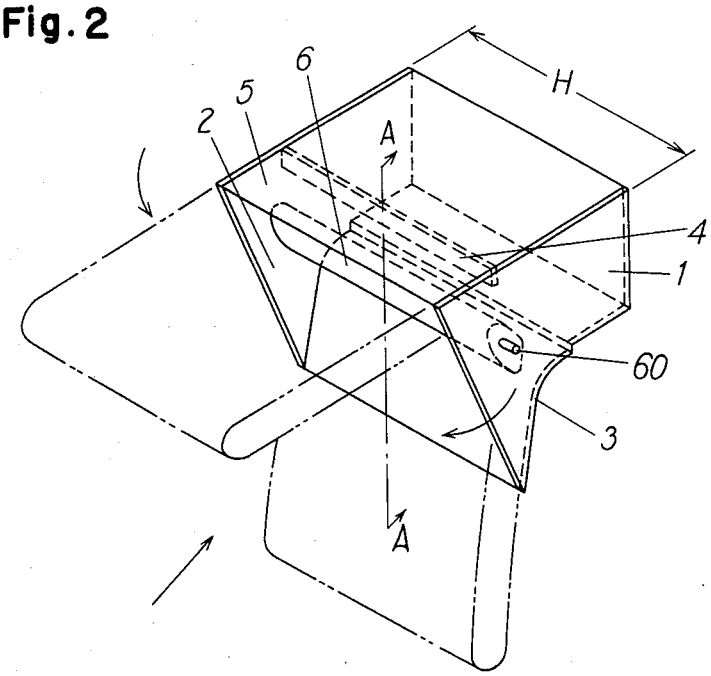
FIG. 2 is a perspective view of the whole part of a flow direction controller in accordance with an embodiment of the invention.
Figure 3:
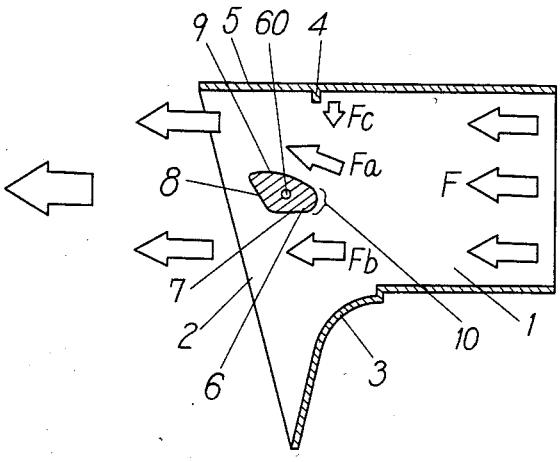
FIG. 3 is a sectional view taken along the line A—A of the controller shown in FIG. 2 with the control blade 6 positioned for horizontal blowing.
Figure 4:
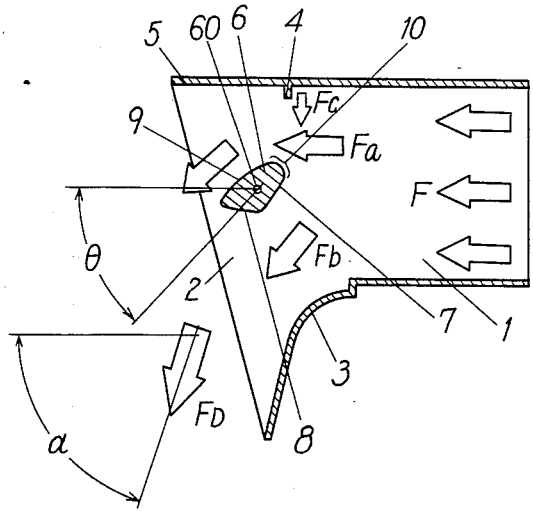
FIG. 4 is a view similar to that in FIG. 3 with the control blade 6 positioned for downward blowing.
Figure 5:
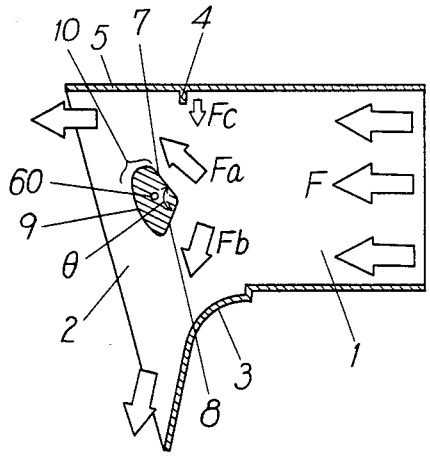
FIG. 5 is also a similar view with the control blade 6 positioned for split blowing of the air.

Referring to FIGS. 2 to 5, reference numeral 1 denotes a blow out passage, 2 denotes an air outlet, 3 denotes a curved flow-attaching wall (this may include a straight section downstream from the curve as illustrated), 4 denotes a means provided on the wall opposite to the flow-attaching wall 3 and adapted to bias the flow inwardly (towards the flow-attaching wall 3), (referred to simply as "biasing projection", hereinunder), 5 denotes a straight flow-attaching wall disposed downstream from the biasing projection 4, and 6 denotes a control blade rotatable around the axis of a shaft 60 which extends perpendicularly to the direction of flow of air and in parallel with the flow-attaching wall 5. As will be seen from the drawings, the control blade 6 is a columnar member having a substantially triangular cross-sectional shape, and is constituted by biasing surfaces 7 and 8 and a curved portion (wall presenting a curved surface) 9. For the purpose of simplification of the description, the surface designated at a numeral 7 will be referred to as a "downward-blow biasing surface", while the surface designated at 8 will be called as "split-flow biasing surface", hereinunder. The downward-blow biasing surface 7 and the split-flow biasing surface 8 having substantially rectilinear forms, and are jointed to each other at an angle $\theta$ to provide a configuration which divides the flow of air into two components at different directions (Fa and Fb) when the control blade 6 takes an angular position for split-flow of the air as shown in FIG. 5, so that one of the flow components attaches to the linear flow-attaching wall 5 and the other to the curved flow-attaching wall 3. Preferably, this angle is about 120°. On the other hand, when the control blade 6 takes a position other than the position for the split-flow of the air, e.g. a position as shown in FIG. 3 or FIG. 4, the curved portion 9 and the downward-flow biasing surface 7 cooperate to direct the discharged air in a spontaneous direction within the range between the horizontal and downward directions. In order to avoid any turbulence of the air, the joint portion between these two surfaces has a substantially arcuate form and these two surfaces extend substantially in parallel with each other at a small angle left therebetween.

Figure 8:
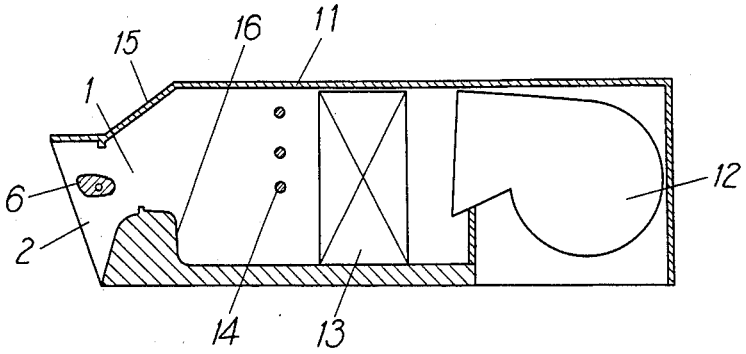
FIG. 8 is an illustration of an overhead heat pump to which the invention is applied.

FIG. 8 shows an overhead heat-pump type air conditioner to which the described embodiment is applied. This air conditioner has a casing 11, Silocco fan 12, heat exchanger 13, heater 14, an inclined top panel 15 for restricting the blow out passage, and a lower restriction 16.

In this air conditioner, the direction of the air blown from the air conditioner is controlled in the manner shown in FIGS. 3 to 5 in accordance with the rotation of the control blade 6. Namely, FIGS. 3, 4 and 5 show, respectively, the flow direction controller in the states for the horizontal blowing, downward blowing and split-flow of the discharged air.

The state for the horizontal blowing will be explained first with reference to FIG. 3. In this case, the control blades 6 takes the horizontal position (the position shown in FIG. 3). The flow of air coming from the upstream side is divided by the control blade 6 into two parts: namely, the upper flow component Fa which flows along the upper side of the control blade 6 and the lower flow component Fb which flows along the lower side of the control blade 6. This division of the air flow can be conducted without substantial turbulence of air because the joint portion 10 has a substantially arcuate form. The flow component Fa is biased by a component Fc produced by the biasing projection 4 so as to flow along the curved portion 9, while the flow component Fb flows along the downward-blow biasing surface 7. The flow component Fa along the curved portion 9 interferes with the straight flow-attaching wall 5 to flow along the latter.

On the other hand, the downward flow Fb flows along the downward-blow biasing surface 7 and merges into the upper flow component Fa to form a generally horizontal flow of air.

The state for downward blowing will be described with reference to FIG. 4. In this state, the control blade has been rotated 60° counter-clockwise from the position shown in FIG. 3. In this case, the flow of the discharged air is divided into the flow component Fa on the upper side of the control blade 6 and the lower flow component Fb on the lower side of the control blade 6, as in the case of horizontal blowing. The upper flow component Fa is biased downwardly by the flow component Fc produced by the biasing projection 4, so as to attach to the curved portion 9 of the control blade 6.

On the other hand, the lower flow component Fb is biased downwardly by the downward-blow biasing surface 7 and attaches to the flow-attaching wall 3 by the Coander effect. Since the upper flow component Fa moves along the curved position 9 of the control blade 6, it can easily be merged in the lower flow component Fb to form a flow which attaches to the flow-attaching wall 3 and, hence, deflected to the lower side. Since the downward flow of the air makes efficient use of the attaching effect to the wall, it is possible to attain a downward deflection angle of about 80° with a flow-rate reduction ratio of less than 10% to the flow rate of air obtained in the horizontal blowing.

The state for split-flow of air will be explained hereinunder with respect to FIG. 5. In this state, the control blade 6 has been rotated about 120° counter-clockwise from the position for the horizontal blowing. As in the preceding cases, the flow F of air is divided into the upper flow component Fa flowing on the upper side of the control blade 6 and the lower flow component Fb flowing on the lower side of the same. In this case, however, the upper flow component Fa is deflected by the action of the downward-blow biasing surface 7 to attach to the straight wall 5 and is efficiently attached to the latter so as to be directed horizontally. On the other hand, the lower flow component is deflected by the action of the split-flow biasing surface 8 to attach to the attaching wall 3 so as to be discharged downwardly along the wall 3.

Consequently, the air is discharged in the form of a horizontal component and a downward component which are split from each other.

Figure 6:
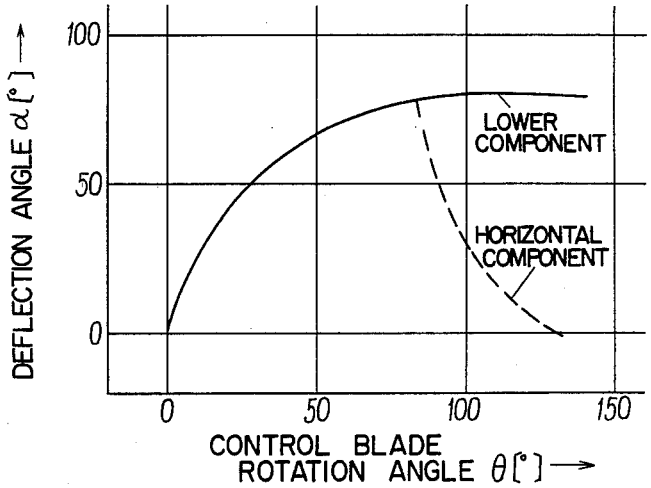
FIG. 6 is a chart showing the air deflecting characteristics of the embodiment of the invention.
Figure 7:
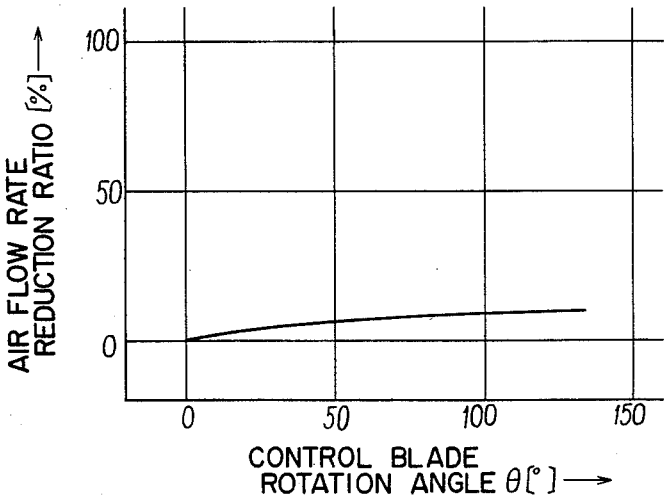
FIG. 7 is a chart showing the flow-rate characteristics of the embodiments.

The deflecting characteristics and the flow-rate characteristics as observed in this state are shown in FIGS. 6 and 7. In these Figures, the axis of the abscissa represents the rotation angle $\theta$ of the control blade, which is the angle formed between a line substantially parallel with the downward-blow biasing surface 7 and the direction F of the incoming flow as shown in FIG. 4. In FIG. 6, the axis of the ordinate represents the deflection angle $\alpha$ which is, as shown in FIG. 4, the angle between the direction of the incoming flow F and the direction of the outgoing flow $F_D$, while the axis of the ordinate in FIG. 7 represents the ratio of reduction of the air flow rate. From these Figures, it will be seen that the deflection angle $\alpha$ is increased up to about 80° in accordance with the rotation angle $\theta$ of the control blade 6. The flow of air is divided into two components, i.e. the lower component and the horizontal component, when the angle $\theta$ is increased to about 120°. The ratio of reduction of the air flow rate does not exceed 10% even in this condition. This value of the air flow rate reduction ratio is small enough to permit the flow direction controller of the invention to be of practical use in an air conditioner.

When the flow direction controller of the invention is used in an overhead heat-pump type air conditioner as shown in FIG. 8, the flow of air discharged from the Silocco fan is heated or cooled as it flows through the heat exchanger 13 or the heater 14, before entering the blow out passage 1 of the flow direction controller. This flow of air is deflected upwardly or downwardly or made to flow out in the form of flow components splitting from each other. Accordingly, it becomes possible to attain the most comfortable blow of air by effecting such a control that, when the air conditioner operates in the cooling mode, the cold air is discharged horizontally, whereas, in the heating mode of the air conditioner, the air is blown downwardly if the air flow rate is not so large and in the form of horizontal and downward flow components if the flow rate of the heated air is large.

Figure 9:
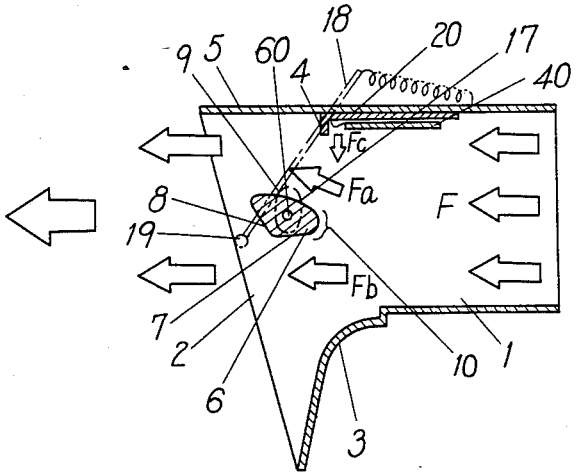
FIG. 9 is a sectional view of a second embodiment of the invention with the control blade 6 positioned for the horizontal blowing.

A second embodiment of the invention will be described hereinunder with reference to FIGS. 9 to 11. In this second embodiment, the biasing projection 4 is movable substantially in parallel with the blow out passage 1 in accordance with the rotation of the control blade 6. More specifically, the biasing projection 4 is adapted to slide between the straight wall 5 and a guide plate 40, and is operatively connected to the control blade 6 by a mechanism as shown in FIG. 9. A cam 17 is provided on the end of an extension of a shaft 60 of the control blade 6 so that the cam 17 rotates together with the control blade 6. As the cam 17 rotates, the transmission rod 18 rocks around a transmission shaft 19 so as to move the biasing projection 4 through a jointing projection on the biasing projection 4. The transmission rod 18 is held in contact with the cam 17 by means of a reset spring.

Figure 10:
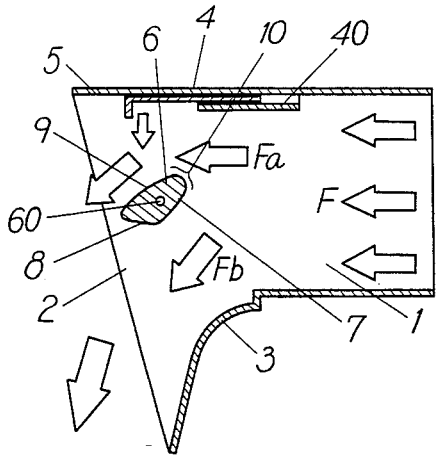
FIG. 10 is a sectional view similar to that in FIG. 9, with the control blade 6 positioned for downward blowing.
Figure 11:
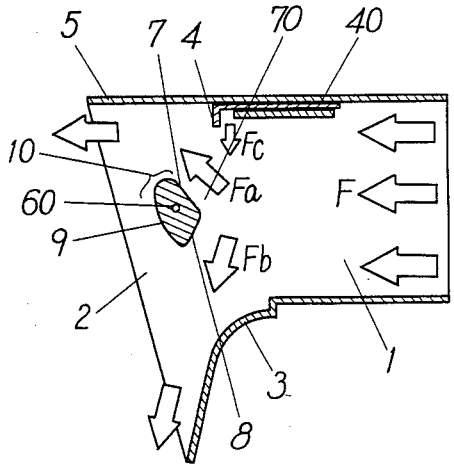
FIG. 11 is a sectional view similar to that in FIG. 9, with the control blade 6 positioned for split blowing of the air.

With this arrangement, the second embodiment of the invention operates in manner explained hereinunder with reference to FIGS. 9 to 11.

Referring first to FIG. 9, which shows the state for horizontal flowing the biasing projection 4 has been moved to the upstream side as viewed in the direction of the flow to provide a large length of the straight wall 5. This condition permits a more perfect attaching of the upper flow component Fa to the straight flow-attaching wall 5 to realize a higher uniformity of the flow velocity distribution in the horizontal blow. As the control blade 6 is inclined to the position for the downward blow, the transmission rod 18 is moved by the action of the cam 17 so that the biasing projection 4 is moved to the downstream side. This condition enhances the attaching of the upper flow component Fa to the curved portion 9 of the control blade 6 so that the merging of the flow components Fa and Fb at the downstream side of the control blade 6 is facilitated, and the deflection angle in the downward blow is increased with uniform flow velocity distribution. FIG. 11 shows the state in which the control blade 6 has been rotated from the position for the downward blow to the position for the split-flow of the air. In this case, the biasing projection 4 is moved again to the upstream side to enhance the attaching of the upper flow component Fa to the straight flow-attaching wall 9 so that the split-flow of air can be realized in a more perfect condition. Thus, in the second embodiment, the biasing projection 4 is moved in accordance with the rotation of the control blade 6 to the positions optimum for respective blowing states so as to increase the deflection angle of the flow and to improve the flow velocity distribution thereby to enhance the effect of the air conditioning.

Figure 12:
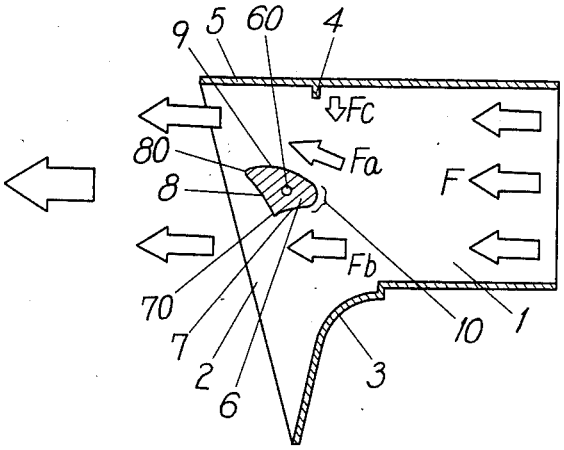
FIG. 12 is a sectional view of a third embodiment, with the control blade 6 positioned for horizontal blowing.
Figure 13:
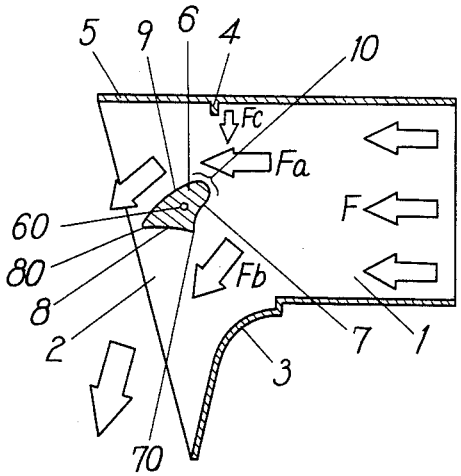
FIG. 13 is a sectional view similar to that in FIG. 12, with the control blade 6 positioned for downward blowing.
Figure 14:
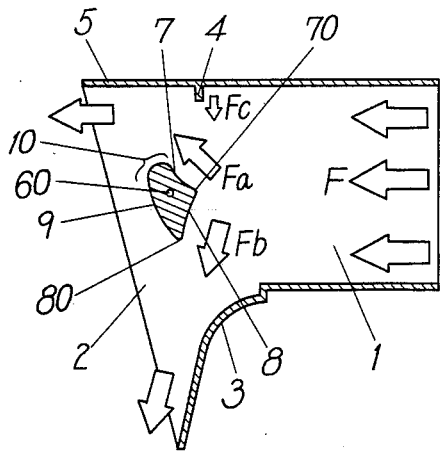
FIG. 14 is a sectional view similar to that in FIG. 12, with the control blade positioned for split-blowing of the air.

A third embodiment of the invention will be described hereinunder with reference to FIGS. 12 to 14. In this case, the control blade 6 is provided on its downward-blow biasing surface 7 and the split-flow biasing surface 8, respectively, with projections 70 and 80 for enhancing the effects of these biasing surfaces. As will be seen from the Figures, the greatest effect is obtained when these projections are provided on the downstream ends of respective biasing surfaces. The operation of this embodiment will be explained hereinunder with reference to the drawings. As will be seen from FIG. 12, the horizontal blow is achieved in the same way as that in the first embodiment. The downward blow also is achieved in a way substantially the same as that in the first embodiment as will be seen from FIG. 13. In this case, however, the attaching of the lower flow component Fb to the flow-attaching wall 3 is enhanced by the projection 70 provided on the downward-blow biasing surface. At the same time, the attaching of the upper flow component Fa to the curved portion 9 is enhanced by the effect of the projection 80 provided on the split-flow biasing surface 8 so that the downward deflection angle is further increased. As shown in FIG. 14, in the state for the split-flow of the air, the attaching to the flow-attaching wall 3 is increased by the effect produced by the projection 80 provided on the split-flow biasing surface 8, so that the split-flow of the air is realized without fail even when there is turbulence in the incoming flow of air. Although the illustrated embodiment has projections 70 and 80 formed on respective biasing surfaces, it is not always necessary to provide both of these projections. Namely, each projection has its own advantage even when it is provided solely.

Figure 15:
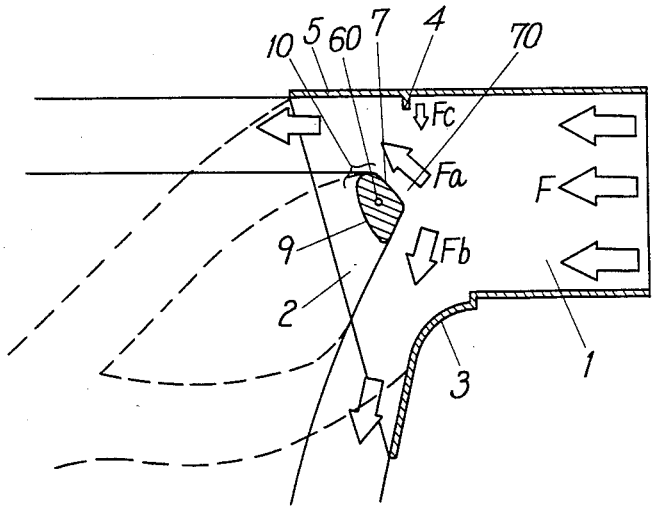
FIG. 15 is a sectional view taken along the line A—A of FIG. 2, with the control blade 6 positioned for split-blowing of the air.
Figure 16:
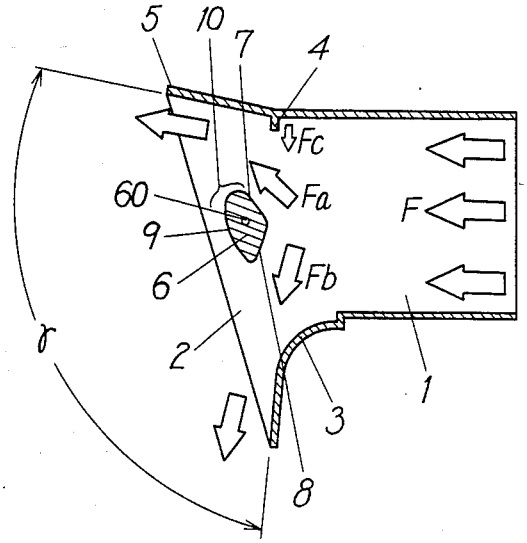
FIG. 16 is a sectional view of a fourth embodiment of the invention.

A fourth embodiment of the invention will be described hereinunder with reference to FIGS. 15 and 16. The embodiments described hereinbefore involve a problem; the split-flow becomes imperfect as the width H shown in FIG. 2 becomes large, although no substantial effect is produced when the width H is small, due to the following reasons. In the split-flow mode of the operation, the jets of air in respective directions effect the air around these jets. When the width H is sufficiently small, no vacuum is generated in the space between two jets, because the ambient air flows from the front and lateral sides to make up for involvement of the air around the jets. As the width H is increased, however, a vacuum is generated in the space between the two jets because the rate of make up of the air from the lateral sides is constant. Consequently, these jets of air are attracted by each other and finally merge with each other. (see the broken lines in FIG. 15). Consequently, the separate jets are undesirably united into a single jet.

In this regards, it is to be noted that, in the embodiment under the description, the angle formed between the line tangent to the downstream end of the curved flow-attaching wall 3 and the substantially straight flow-attaching wall is selected such that the angle formed between the flow components attaching to respective flow-attaching walls is greater than the angle at which the merging of these flow components due to involvement of ambient air takes place. Therefore, in the split-flow mode of the operation, although the two jets involve the ambient air, this involvement is made up for by the supply of the air from the front side so that the generation of vacuum between these two jets is avoided thanks to the large angle $\gamma$ formed between the jets. (This angle should be at least 90°). Thus, no make-up air from the lateral sides is necessary to compensate for the air involved by the jets even when the width H becomes large, so that the splitting state of the flow components never fails. In addition, partly because the straight flow-attaching wall 10 is directed somewhat upwardly while the downstream end of the curved flow-attaching wall 3 is directed substantially downwardly, the flow components in the splitting state diverge in a greater angle, which in turn ensures a small reduction of the air flow rate and a greater angle of deflection.

Figure 17:
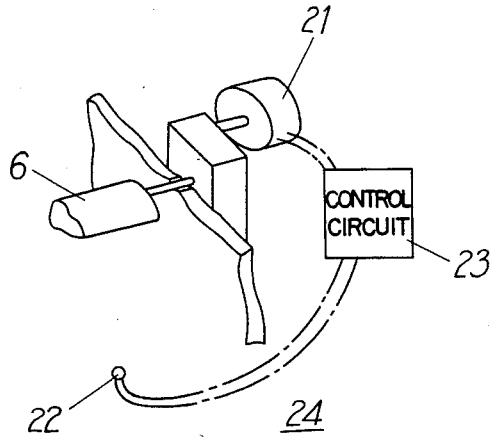
FIG. 17 is a schematic illustration of a controller.

Referring now to FIG. 17, a control system 24 is composed of a stepping motor 21 for driving the control blade 6, a temperature sensor 22 for sensing the blown air, and a control circuit 23 for controlling the rotation angle of the steping motor in accordance with the temperature of the blow air. With this arrangement, it is possible to optimize the blowing condition to maintain a comfortable flow of the conditioned air, by effecting the control in such a manner that the air blows horizontally when the air temperature is lower than a predetermined temperature (a temperature at which the user does not feel the air to be too cold), while the air blows in the form of components splitting from each other when the air temperature is above the predetermined temperature.

As has been described, according to the invention, the control blade is composed of two surfaces capable of producing biasing effects and a curved portion. The attaching of the flow to the curved portion and the biasing effect produced by two biasing surfaces in combination serve to deflect the flow of air by making an efficient use of the attachment of the of flow to the curved flow-attaching wall and the straight flow-attaching plate, thereby to permit a deflection of the air over a wide angular range and split-flow of the air without being accompanied by a substantial reduction in the air flow rate. Therefore, by applying this flow direction controller to an air conditioner, for example, it is possible to control the air flow to maximize the comfort of the user, thereby to remarkably enhance the effect of air conditioning.

What is claimed is:

1. A flow direction controller having a plurality of operating modes including a split-flow mode, comprising:

means defining a blow out passage having first and second spaced-apart sides and having an interior region between said sides for conveying an air flow that is moving from upstream to downstream through said passage, said means including a first flow-attaching wall provided at said first side of said passage, at least a portion of said flow-attaching wall being curved, a biasing means provided on the second side of said passage for directing the flow toward said interior region, and a substantially straight second flow-attaching wall disposed at said second side of said passage and downstream of said biasing means; and a control blade that is mounted in the interior region of said blow out passage for rotation about an axis that extends perpendicular to said flow and substantially in parallel with said straight flow-attaching wall, said control blade being a columnar member having a substantially triangular cross-section with three angularly disposed surfaces, two surfaces out of the three surfaces constituting said columnar member being substantially straight and being disposed with respect to each other at an angle which is the maximum among the three angles formed between adjacent ones of the three surfaces so that said flow is divided into two components in the split-flow operation mode and said components are biased to attach to the first and second flow-attaching walls, the remaining surface of said control blade being curved so that a flow passing between it and said biasing means attaches to said remaining surface and being adapted to cooperate, in an operation mode other than said split-flow operation mode, with the upstream one of said two surfaces thereby to direct said flow in one direction.

2. A flow direction controller according to claim 1, wherein said biasing means is movable along said second side of said blow out passage, and further comprising means operatively connected to said control blade for moving said biasing means when said control blade is rotated.

3. A flow direction controller according to claim 1, wherein at least one of said surfaces of said control blade is provided thereon with a projection for enhancing the biasing effect thereof.

4. A flow direction controller according to claim 1, wherein the angle formed between a line tangent to the downstream end of said first flow-attaching wall and said second flow attaching wall is selected to be greater than the angle at which the flow components having attached to said two walls come to merge in each other due to a vacuum formed in the space between said flow components.

5. A flow direction controller according to claim 1, wherein said modes include a horizontal blow mode in which substantially all of said air flow exits said passage along said second flow-attaching wall, and further comprising a control system means for positioning said control blade for said horizontal blow mode when the temperature of the blown air is lower than a predetermined temperature and for said split-flow mode when the air temperature is higher than said predetermined temperature.

6. A flow direction controller according to claim 1, wherein said angle which is the maximum among the three angles is substantially 120°.

* * * * *